US005291777A

United States Patent [19]

Chang et al.

[11] Patent Number: 5,291,777

[45] Date of Patent: Mar. 8, 1994

[54] SYSTEM FOR MONITORING OIL WELL PERFORMANCE

[75] Inventors: Victor Chang; Noel Moreno, both of Miranda; Cesar Alvarez, Caracas, all of Venezuela

[73] Assignee: Intevep, S.A., Caracas, Venezuela

[21] Appl. No.: 848,665

[22] Filed: Mar. 9, 1992

[51] Int. Cl.[5] ..... E21B 47/00

[52] U.S. Cl. ..... 73/151; 417/18

[58] Field of Search ..... 73/151, 862.627; 324/127, 117 R; 33/366, 396; 417/18, 12

[56] References Cited

U.S. PATENT DOCUMENTS

| | | | |
|---|---|---|---|
| 894,620 | 7/1908 | Frank | 324/127 |
| 1,489,665 | 4/1924 | Foster et al. | 324/127 |
| 3,056,922 | 10/1962 | Du Vall et al. | 324/127 |
| 3,837,222 | 9/1974 | Raskin | 73/862.637 |
| 3,864,966 | 2/1975 | Seitz | 73/862.627 |
| 4,142,411 | 3/1979 | Deal | 73/155 |
| 4,143,546 | 3/1979 | Weiner | 73/151 |
| 4,475,409 | 10/1984 | Zulliger | 73/862.627 |
| 4,561,299 | 12/1985 | Orlando et al. | 73/151 |
| 4,817,049 | 3/1989 | Bates et al. | 73/151 |
| 4,873,635 | 10/1989 | Mills | 73/151 |
| 4,947,936 | 8/1990 | Ellwood | 73/151 |
| 5,063,776 | 11/1991 | Zanker et al. | 73/151 |
| 5,076,376 | 12/1991 | Bizet et al. | 73/862.627 |
| 5,134,883 | 8/1992 | Shannon | 33/366 |
| 5,167,490 | 12/1992 | McKee et al. | 73/151 |
| 5,182,946 | 2/1993 | Boughner et al. | 73/151 |

*Primary Examiner*—Robert J. Warden
*Assistant Examiner*—Hien Tran
*Attorney, Agent, or Firm*—Bachman & LaPointe

[57] ABSTRACT

A system for monitoring performance of a pumping unit of an oil well includes a first sensor for measuring the inclination angle of a beam forming part of the pumping unit, a second sensor for measuring the load on the beam, and a third sensor for measuring the load on an electrical motor used in conjunction with the pumping unit. The first sensor includes a cantilevered pendulum member which moves in response to changes in the beam inclination angle and strain gauges affixed to the pendulum member for generating an electrical signal indicative of the instantaneous inclination angle. The second sensor includes a deformable sensor plate mounted to the beam and piezoresistive gauges attached to the plate for providing a signal indicative of the load on the beam. The third sensor includes a sensor head attached to a cable for supplying electrical power to the motor. The sensor head includes a sensor coil spaced from the cable so that the magnetic field surrounding the cable induces a current flow in the sensor coil. By measuring the voltage across the ends of the sensor coil, a signal indicative of the load on the motor is generated.

9 Claims, 6 Drawing Sheets

SYSTEM FOR MONITORING OIL WELL PERFORMANCE

BACKGROUND OF THE INVENTION

The present invention relates to a system for monitoring the performance of oil wells system includes a beam deformation sensor, a current intensity loading sensor and a beam angle sensor.

In the petroleum industry, there are many thousands of production oil wells, many in remote locations. Forty percent of these wells work with a beam type pumping unit having a beam displaceable through an angular range, a sucker rod connected to the beam and an electric driving motor for causing angular movement of the beam through a rotating member and a connecting member between the rotating member and the displaceable beam. FIG. 1 illustrates a typical beam type pumping unit of this type.

Normal wear and tear, as well as the nature of the fluid being pumped and/or abnormal pumping conditions, can cause such problems as worn-out pumps, broken sucker rods, split tubing, malfunctioning vacuum pumps, and stuck pump valves - all of which interfere with and interrupt normal pumping operations. Maintenance of these wells and their equipment demands many man-hours. Despite continuous maintenance programs, well imperfections and failures are often detected too late by maintenance crews and their supervisory personnel resulting in large repair expenses.

As mentioned above, beam pumping units are typical. In order to detect possible malfunctions in the well pumping system, two variables are measured-the load on the displaceable beam and the displacement of the beam. These two measured variables are used to obtain a diagram known as a dynagraphical chart or dynagraph. From these charts, performance of the well is monitored.

Over the years, different pieces of equipment and different types of systems have been developed to detect problems in the pumping units of these oil wells. For example, some wells are equipped with a force sensor placed directly at the polished rod of the beam pumping unit and a second sensor which measures the displacement of the beam. From the measurements recorded by these sensors, it is possible to obtain the desired dynagraphs.

Some wells are also equipped with sensors for monitoring the performance of the electrical motors used in the well. These sensors typically consist of a loading coil designed for use with an electrical motor so that the loading coil voltage is proportional to the current circulating through the motor feeder cables.

The principal deficiency of these sensors has been an inability to provide maintenance personnel with an accurate picture of the condition of the well equipment. The electrical motor sensors are further deficient in that they lack a system which permits normalization of different currents into instrumentation standard outputs.

Accordingly, it is an object of the present invention to provide an improved system for monitoring well performance.

It is a further object of the present invention to provide an improved current intensity loading sensor to be incorporated into said system.

It is still a further object of the present invention to provide an improved current intensity loading sensor as above having means to permit normalization of the output to industry standard outputs.

It is yet another object of the present invention to provide an improved beam deformation sensor to be incorporated into the well monitoring system.

Still another object of the present invention is to provide an improved beam angle sensor to be incorporated into the well monitoring system.

These and other objects and advantages of the present invention will become more apparent from the following description and drawings wherein like reference numerals depict like elements.

SUMMARY OF THE INVENTION

The foregoing objects are attained by the well monitoring system of the present invention which includes a beam angle sensor, a beam deformation sensor and a current intensity loading sensor.

The beam angle sensor used in the monitoring system of the present invention indirectly measures the displacement of the polished rod in a beam pumping unit of a production well. The indirect measurement of the displacement is accomplished by measuring the instantaneous angle of inclination of the polished rod. The beam angle sensor includes a pendulum member housed within a body at least partially filled with a viscous fluid for damping oscillatory movement of the pendulum member. The beam angle sensor further includes means for causing movement of the pendulum member in response to the movement of the beam and means for generating an electric signal indicative of the beam inclination angle. The electric signal generating means comprises a series of strain gauges mounted to the surfaces of the pendulum member.

The beam deformation sensor used in the monitoring system of the present invention is used to indirectly measure the load on the beam. This is accomplished by measuring the stresses on the beam which are a function of the beam load. The sensor comprises a sensor plate placed in an area of the beam where there is a major flector moment and a series of piezoelectric gauges placed on the sensor plate for measuring the beam stresses.

The outputs of the beam angle sensor and the beam deformation sensor are fed to a computer wherein a load-displacement dynagraph is generated.

The current intensity sensor of the monitoring system of the present invention measures the load which gets into the electric motor used in the production well. The sensor includes a loading coil fitted around the motor feeder cable by means of a set of spring members. The loading coil is isolated from the exterior of and from direct contact with the feeder cable by an electrically non-conductive material. The sensor further includes electrical means for normalizing the output of the sensor to instrumentation standard outputs. This allows the sensor to be used with a variety of different instruments.

While the sensors of the present invention will be discussed in the context of a particular type of production oil well, they actually have applications in a variety of technological areas where it is important to detect or measure variables such as inclination, impact, vibration, angular position, and electrical power loads.

BRIEF DESCRIRIPTION OF THE DRAWINGS

DETAILED DESCRIPTION

Figure 1:
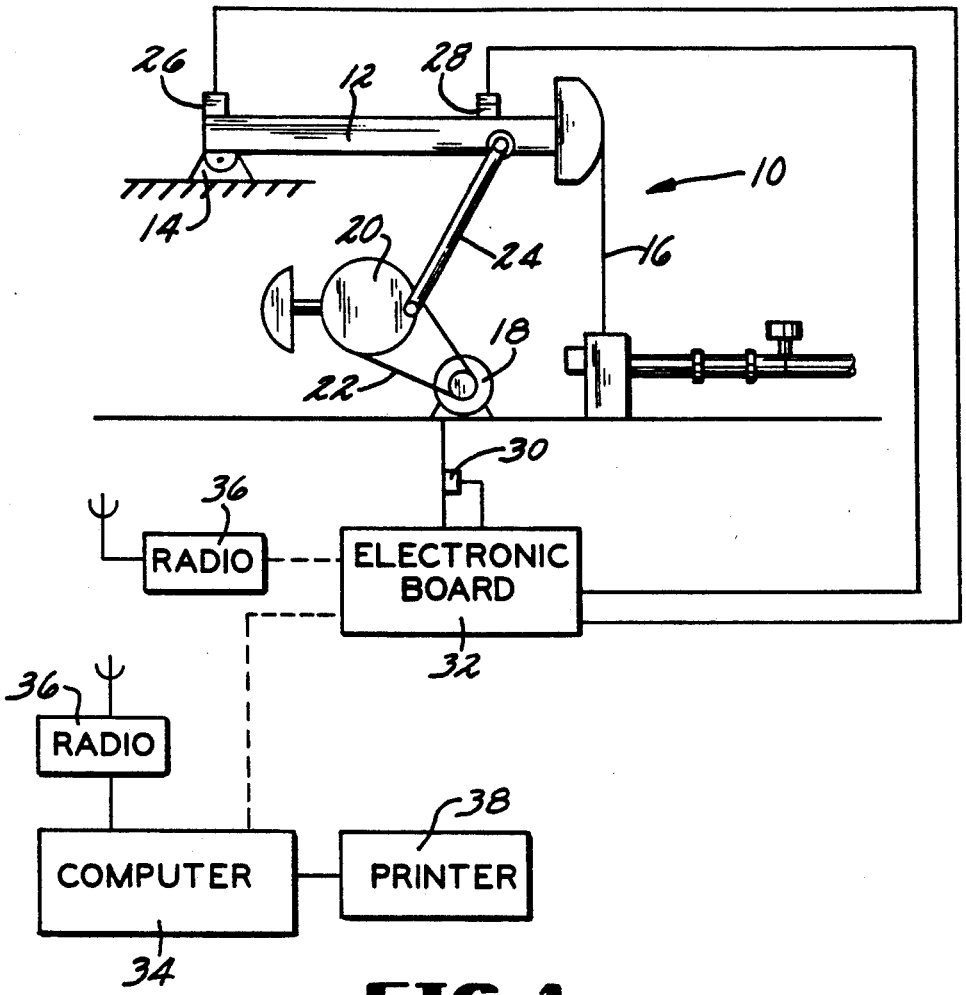
FIG. 1 illustrates an oil production well of the beam pumping type illustrating the location of the sensors of the present invention.

FIG. 1 illustrates a typical production oil well 10. The well has a beam 12 mounted at one end to a fixed post 14. The opposite end of the beam is mounted to a sucker rod 16 so that angular displacement of the beam 12 causes the sucker rod to move up and down. The well 10 further includes an electric motor 18 for driving a rotatable member 20 via an endless belt drive 22. The rotatable member 20 is connected to the beam 12 by a connecting member 24. As the member 20 is rotated by the electric motor, the beam 12 is displaced through an angular range by the connecting member 24.

In accordance with the present invention, a system for monitoring the performance of the well is provided. The monitoring system includes a sensor 26 for detecting the instantaneous angle of the beam 12, a sensor 28 for detecting the load on the beam 12 and a sensor 30 for detecting the load on the electric motor 18. The output of the sensors 26, 28 and 30 is fed to an electronic board 32 which may be connected to an on-site computer 34 and/or a radio 36 for enabling transmission of the sensor outputs to a remote location. If desired, a printer 38 may be connected to the on-site computer for generating desired graphs and other printed outputs.

Figure 2A:
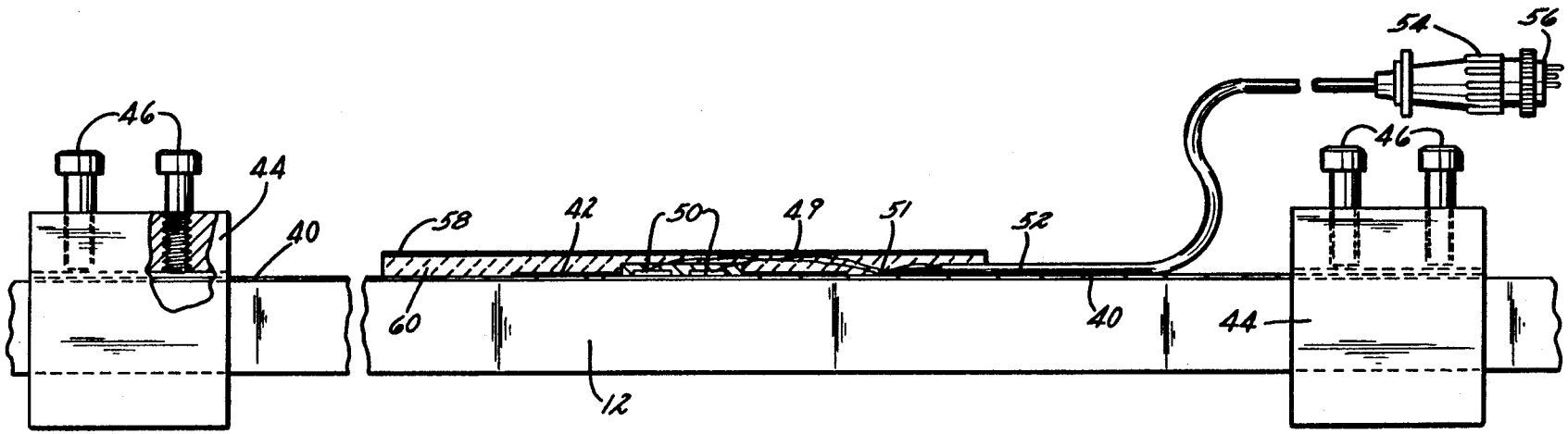
FIG. 2A is a side view of a beam having a beam deformation sensor in accordance with the present invention mounted thereto.
Figure 2B:
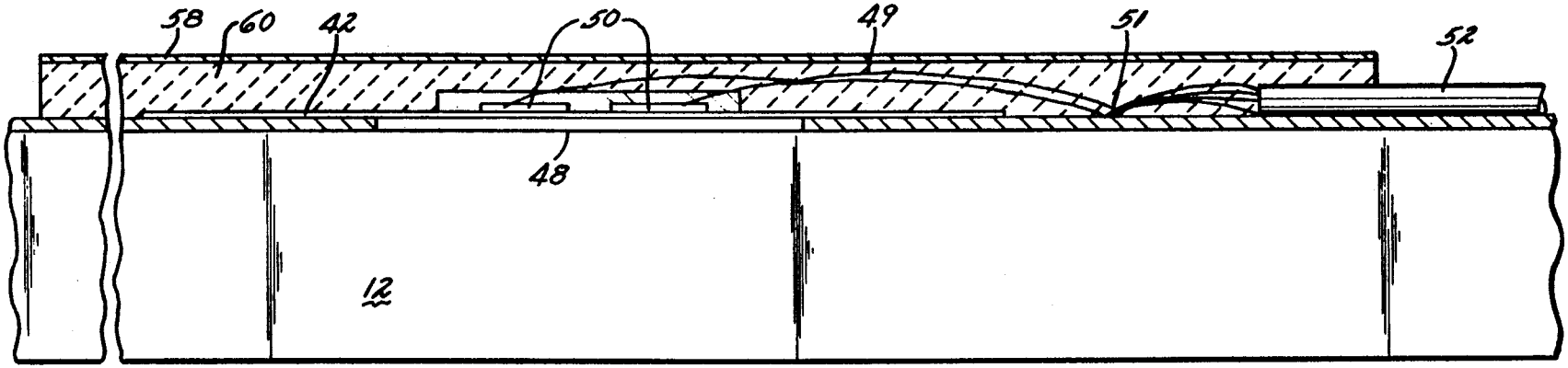
FIG. 2B is an exploded side view of a portion of the sensor illustrated in FIG. 2A.
Figure 3:
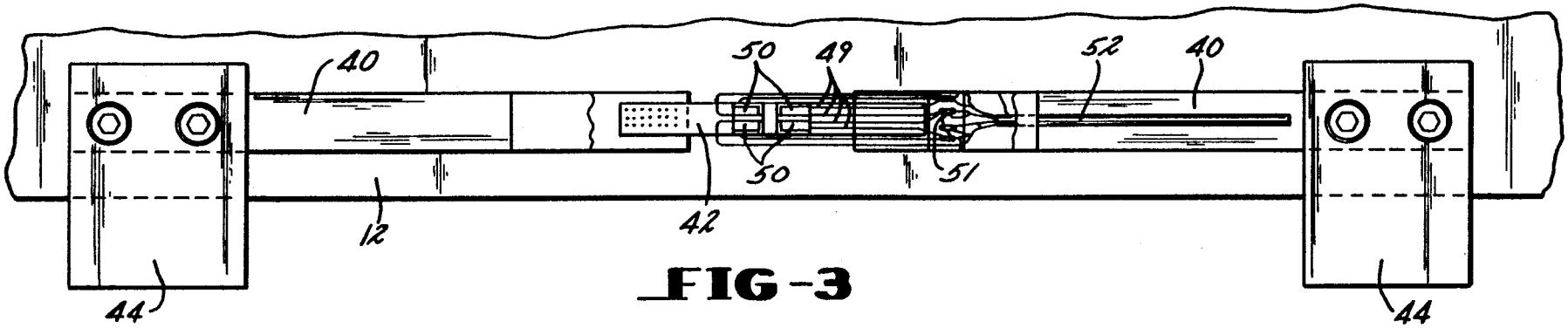
FIG. 3 is a top view of the beam of FIG. 2A with the beam deformation sensor of the present invention.

Referring now to FIGS. 2A, 2B and 3 herein, the sensor 28 indirectly measures the load on the beam by measuring the deformation of the beam, hence it is known as a beam deformation sensor. The sensor 28 includes two spaced apart extension plates 40 which are mounted to the beam 12 by spaced apart clamp mechanisms or presses 44. The presses 44 may have screws 46 which attach the extension plates to a surface 48 of the beam 12. The presses may have any suitable design known in the art.

The extension plates 40 are metal, substantially planar plates having a desired thickness. For example, each plate 40 may be formed by a flat stainless steel plate having a thickness of about 1.2 mm. The plates 40 function primarily as a support for the sensor plate 42. They also serve as a mechanical amplifier for amplifying the deformation of the beam.

The sensor plate 42 is also a substantially planar plate formed from a metallic material such as stainless steel. It differs from the extension plates in that it is very thin, typically on the order of 0.1 mm. The plate 42 is welded at each end to one of the extension plates 40 so as to be suspended off of the beam surface 48.

Piezoresistive strain gauges 50 are mounted on the surface of the sensor plate 42 positioned away from the beam surface 48. Four gauges are positioned on and affixed to the sensor plate in an active half bridge arrangement in such a way such that two of them are placed in a tension position and the remaining two are placed perpendicular to the first two. The remaining two compensate for any expansion due to temperature change of the beam. The gauges 50 may be affixed to the plate 42 in any suitable manner known in the art.

The gauges 50 are connected by wires 49 to an electrical connector 51. The electrical connector 51 is in turn attached to a cable 52 which provides power to the gauges and over which the output signal(s) is carried. The cable 52 has a cable clamp 54 and a connector 56 at its remote end.

To provide rigidity to the sensor construction, a top plate 58 is affixed to the sensor plate 42 in a spaced relationship by a material 60 such as silicone which is placed around the sensors 50 so as to form a protective dampening filling.

The sensor 28 is preferably placed in the area of the beam 12 where the deformation is to be measured such as in an area where there is a major bending moment. The sensor is placed in this location in order to measure the load on the beam indirectly via measurement of the beam deformation. In operation, the extension plates 40 are barely deformed because of their great resistance area as compared to the sensor plate 42. As a result, almost all of the deformation of the beam between the clamp attachment points is transferred to the relatively thin sensor plate, amplifying the deformation of the sensor plate.

The deformation of the sensor plate may be expressed as follows:

$$\Delta E = \frac{1}{L_s} \int_{x_1}^{x_2} E(X)\, dx \tag{1}$$

where:

$\Delta E$=sensor plate deformation;

$E(X)$=Unitary deformation at the point (X);

$X_1$=anchorage position at point A;

$X_2$=anchorage position at point B; and $L_s$=length of the sensor plate.

In the case of a linear distribution of the deformation $$E(X)=mx \tag{2}$$

where m is a constant.

Substituting equation (2) into equation (1) and integrating one finds that:

$$\Delta E = \frac{1}{l_s} \int_{x_1}^{x^2} mx\, dx = \frac{1}{l_s}\, m \frac{x^2}{2} \Big|_{x1}^{x2} = \frac{1}{l_s}\, m(x_2^2 - x_1^2)$$

$$\Delta E = \frac{1}{l_s}\, m\, [(x_2 + x_1)(x_2 - x_1)]^2$$

The length of the sensors between the anchorages $L_s$ equals $x_2 - x_1$

Thus:

$$\Delta E = \frac{L_s}{l_s} xm \frac{(x_2 + x_1)}{2} \quad (3)$$

According to equation (2):

$$\frac{1}{2} m (X_2 + x_1) = \frac{1}{2} [E(X_2) + E(X_1)].$$

This gives the average value of the deformation between the sensor anchorage points $x_2$, $x_1$.

Given this, equation (3) can be rewritten as follows:

$$\Delta E = \frac{L_s}{l_s} E \quad (4)$$

where E=average deformation between the sensor anchorage points and $L_s/l_s$=mechanical gain.

The deformation ΔE induced in the sensor plate 42 generates a bridge electrical disbalance formed by the gauges 50. This signal may be transformed and amplified by a signal conditioning circuit so as to give a standard 0–5V or 4–20 mA signal proportional to the deformation of the beam.

The design of this sensor is quite advantageous in that it permits the sensor to operate under any weather conditions and at temperatures up to 70° C. The sensor also exhibits an increased sensitivity and a better signal to noise ratio than other types of sensors.

Figure 4:
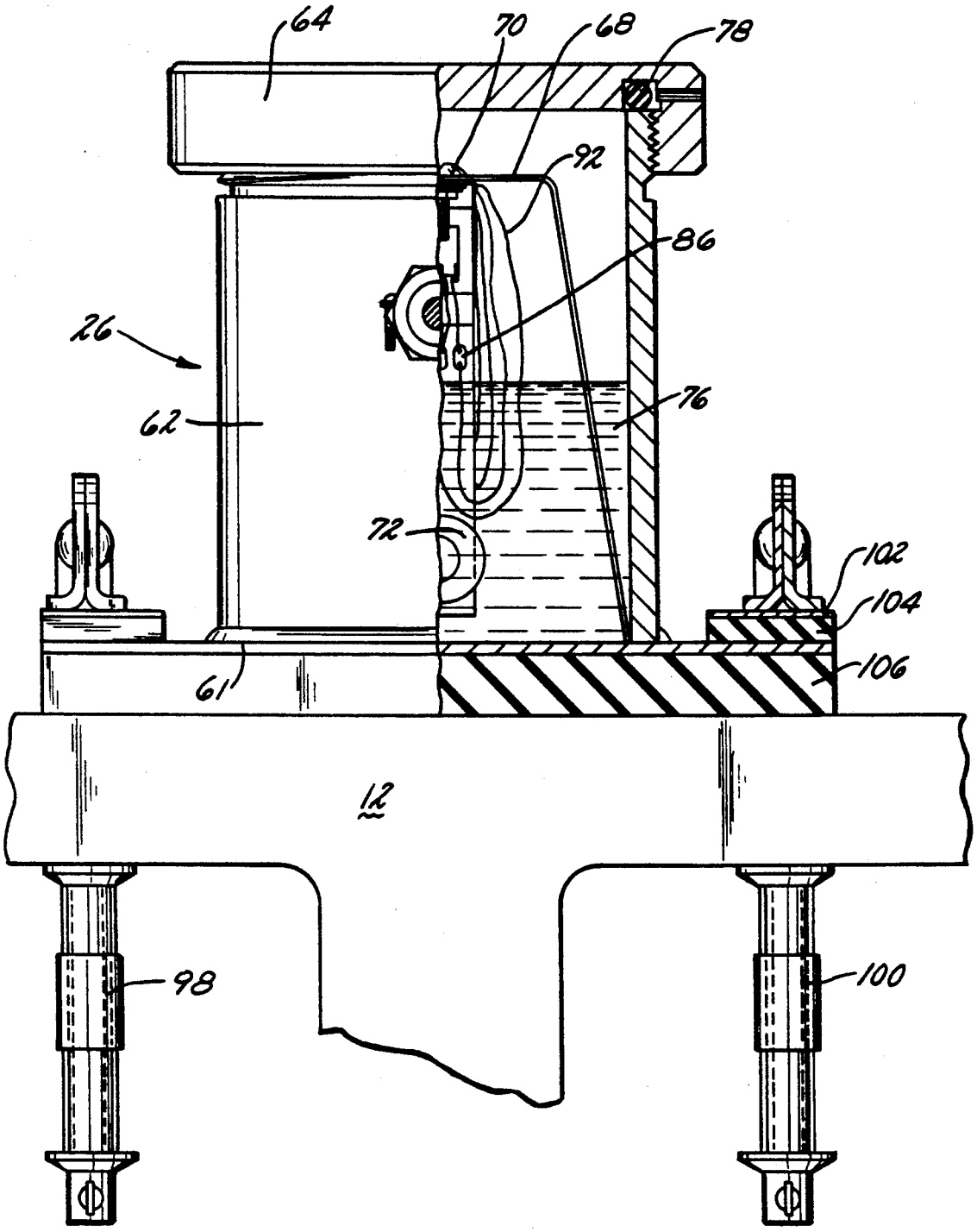
FIG. 4 is a front view in partial section of a beam angle sensor in accordance with the present invention mounted to a beam.
Figure 5:
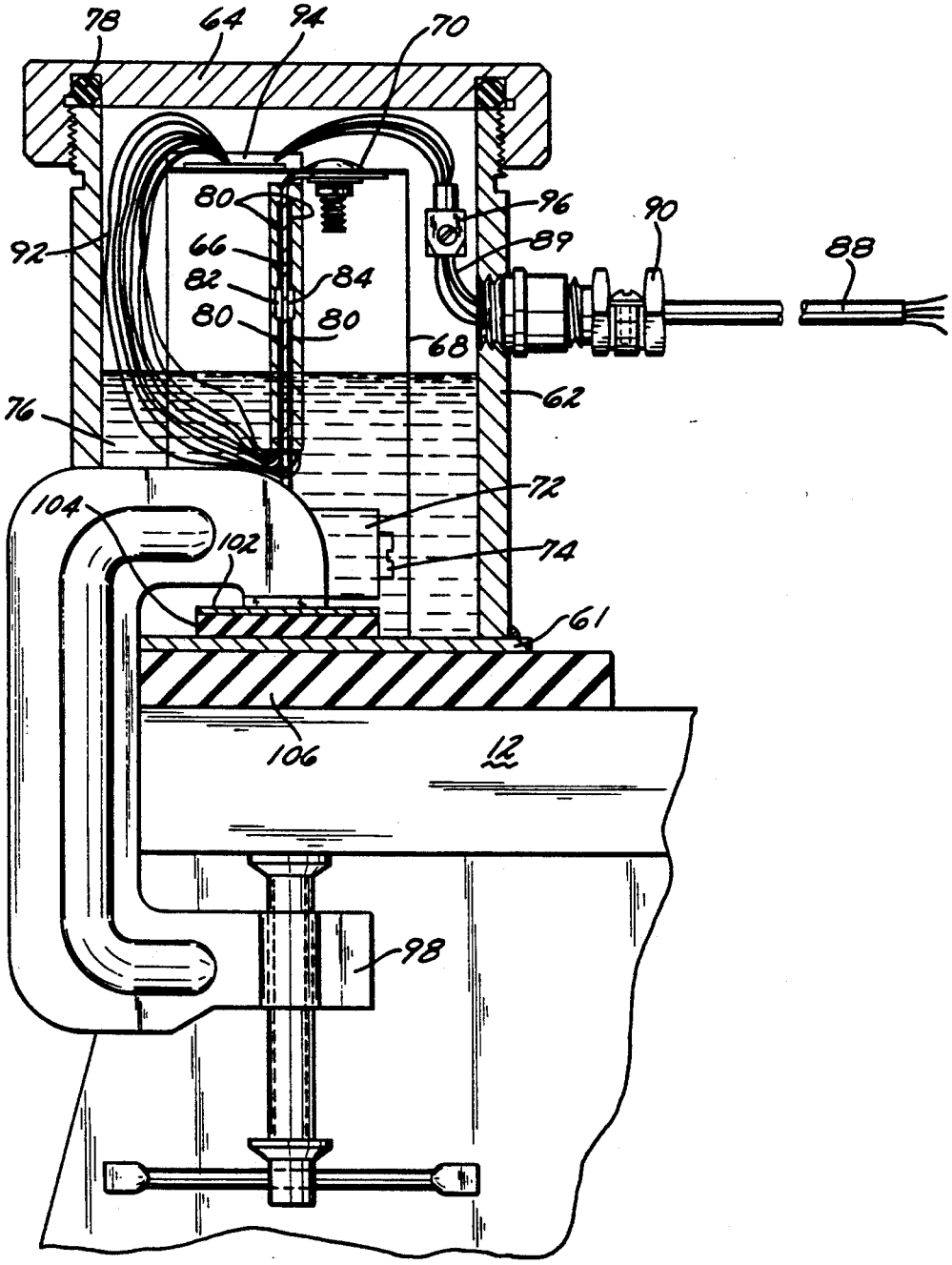
FIG. 5 is a side view of the beam angle sensor of FIG. 4.
Figure 6:
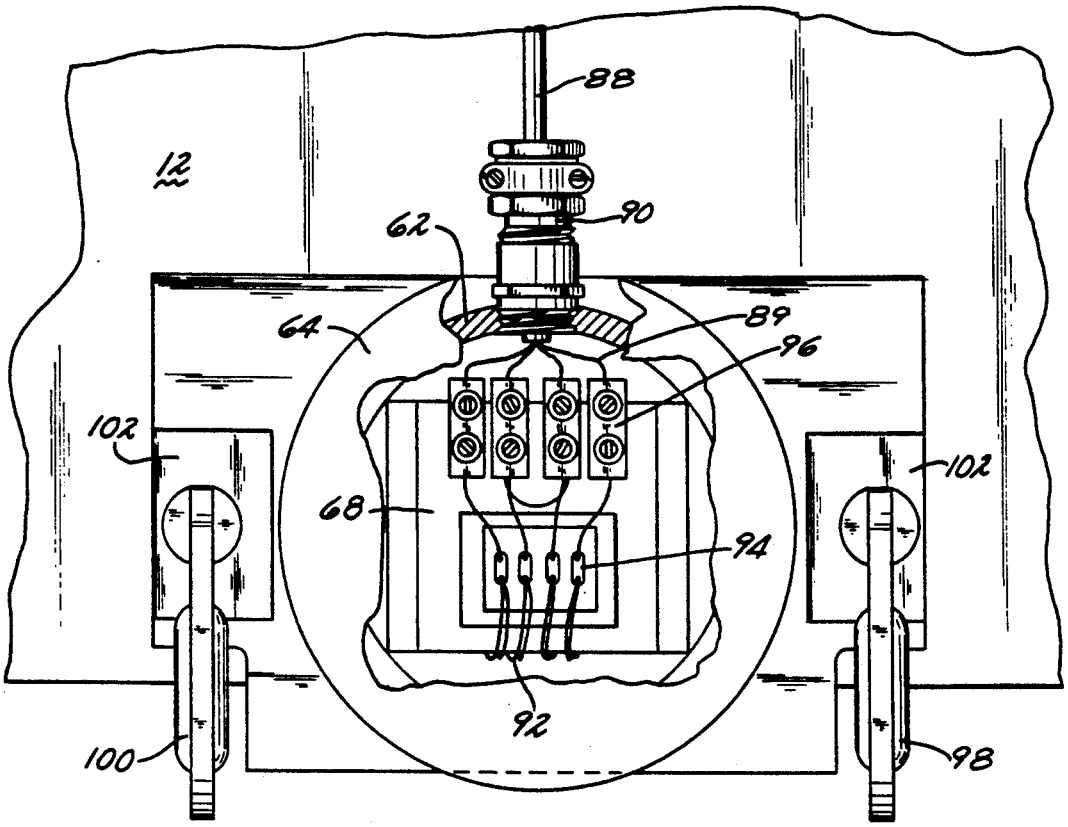
FIG. 6 is a top view of the beam angle sensor of FIG. 4 in partial section.

Referring now to FIGS. 4–6 herein, a sensor 26 is shown which is designed to measure the instantaneous angle of the beam 12. The design is based upon a pendulum formed by a cantilever microbeam in which are disposed strain gauges which provide an electric signal proportional to the inclination angle of the beam.

The beam angle sensor has a base plate 61, a tubular housing 62 secured or welded to the base plate and a threaded cover 64. The pendulum is formed by a cantilevered metal or plastic sheet 66 secured at one end to an inverted substantially U-shaped support 68 by a screw fastener 70. A counterweight 72 is fixed to the sheet 66 at its free end. The counterweight 72 may be fixed to the sheet 66 by any suitable means known in the art such as screw 74.

The sheet 66, support 68 and counterweight 72 are positioned within the housing 62. The housing 62 is filled with one or more viscous fluids 76 to create a damping effect on the sheet and counterweight acting as a pendulum which impedes any oscillation thereof. Up to 50% of the internal volume of the housing 62 may be filled with fluid(s). The fluid or fluids may be an oil or a mixture of oils.

The cover 64 may be provided with an O-ring 78 to reduce the risk of leakage.

Strain gauges 80 are provided on the surfaces 82 and 84 of the sheet 66 for generating an electrical signal indicative of the inclination angle of the beam. The strain gauges may be affixed to the surfaces of the sheet 66 by means of an epoxy resin adhesive. Preferably, two gauges are placed on each surface of the sheet 82, 84 of the sheet 66 with the top most gauge being placed at a point approximately 5mm. from the location where the plate is fixed to support 68, that is, by fastener 70.

The gauges 80 are connected by means of connectors 86 in a Wheatstone bridge circuit. The gauges 80 are connected by means of very flexible and small cables 92 to electrical connectors 94 so as to avoid the introduction of parasitized mechanical loads into the pendulum through the connectors 86.

Cable 88 with plural electrical conductors 89 is provided to feed power to the gauges 80 and to remove the output signal from the bridge circuit. The cable 88 is anchored to the body 62 by the threaded connector 90.

As shown in FIG. 6, the cables 92 are connected to the connectors 94 and 96. As can be seen from this figure, the electrical conductors 89 associated with the cable 88 is also connected to the connector 96.

The sensor 26 is fixed to the beam of a pumping unit or oil well by clamps 98 and 100. The clamps 98 and 100 may be any suitable clamping arrangement known in the art such as the C-clamps shown in FIG. 5. If desired, an adjusting plate 102 and rubber pads 104 and 106 may be provided as part of the clamping assembly.

In operation, angular changes in the beam 12 cause movement of the counterweight 72 due to gravitational forces. The counterweight exerts a force on the sheet 66. This force creates a bending moment which deforms the sheet elastically. As a result, tension or traction stress is produced on one side of the sheet 66, while compression stress is produced on the opposite side.

The gauges 80 placed on the respective traction and compression surfaces of the sheet 66 detect the microstrain produced by the stress as variations in electrical resistance. By measuring the microstrains in this manner, the instantaneous angular position of the beam can be determined.

The sensor 26 is preferably placed at the rotative point of the beam whose angle is to be measured.

Figure 7:
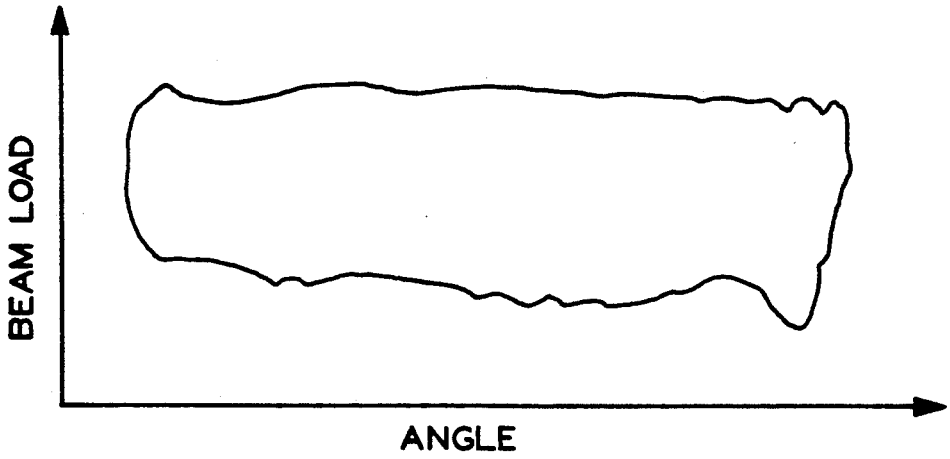
FIG. 7 illustrates a dynagraph.

The output of the beam angle sensor 26 and the output of the beam deformation sensor 28 may be used to generate a dynagraph such as that shown in FIG. 7 to illustrate performance of the oil well or pumping unit being monitored. To generate such a graph the outputs from the sensors 26 and 28 can be transmitted to the on-site computer 34 and the associated printer 38 or an off-site computer and printer. Such a dynagraph can be used to detect an anomaly within the well or pumping unit.

Figure 8:
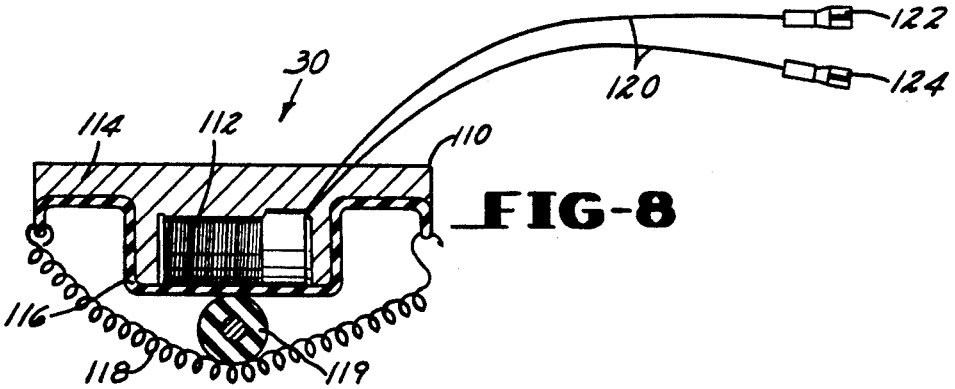
FIG. 8 is a side view of a current intensity loading sensor in accordance with the present invention.
Figure 9:
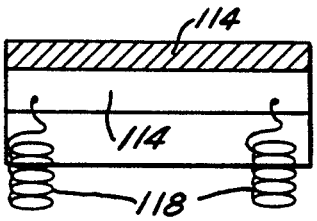
FIG. 9 is a top view of the current intensity loading sensor of FIG. 8.
Figure 10:
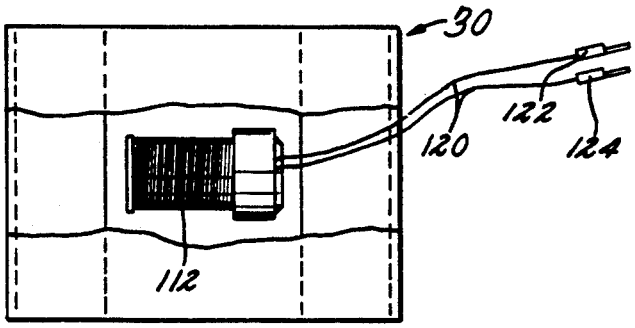
FIG. 10 is a front view of the current intensity loading sensor.

Referring now to FIGS. 8–10, a sensor 30 is illustrated for measuring the load on an electric motor (not shown) of the type used in pumping units or oil wells. The senor is designed to measure the instantaneous current in order to detect phase changes and other parameters which can help calculate the system power consumption.

The system is based upon two principles. The first is the fact that the voltage produced at the extremities of a coil is directly proportional to the inductance value and to the current changes produced through the inductance. The relationship may be expressed as follows:

$$V(t) = L \frac{di}{dt} t \quad (5)$$

where

V(t)=the voltage;

L=the inductance; and di/dt t=current variation with respect to time.

The second operating principle is that when an electron flow circulates through a cable, it provokes a surrounding magnetic field, perpendicular to the cable.

When a second cable is placed near this magnetic field, it provokes an electron flow in the second cable.

Taking into account these principles, a loading coil can be placed around a feeder cable to a motor. Current changes produced in the feeder cable by load changes causes a magnetic field and at the same time a voltage at the ends of the loading coil. This voltage can be measured.

Knowing the voltage across the loading coil, it can be integrated to produce a signal having the same phase as the current The voltage can be expressed as:

$$V_i(t) = K\frac{di(t)}{dt} \quad (6)$$

where $V_i(t)$=input voltage; and

K=constant.

The integrator transference function may be expressed as:

$$V_o(t) = -\frac{1}{RC}\int V_i(t)\,dt \quad (7)$$

where $V_o(t)$=the integrator voltage input.

Resolving the integral, one obtains the following:

$$V_o(t) = -\frac{1}{RC}K\,i(t) \quad (8)$$

where

R=resistance value corresponding to the integrator;

C=capacitance value corresponding to the integrator; and

K=integration constant.

Substituting the components typical values in this equation, a circuit whose output could supply sensitivity voltage and amperes/volt can be obtained.

The sensor 30 comprises a sensor head 110 with a sensor coil 112 which is riveted into an aluminum base 114 and which is covered with an appropriate resin 116. The sensor coil 112 has a 36 mm length and an impedance of 50 to 60 OHMS. The resin 116 serves to prevent direct contact between the cable, whose current is to be measured, and the sensor coil 112. It also functions to isolate the coil 112 from the exterior.

Springs 118 are provided to mount the sensor 30 to a cable 119, such as a motor feeder cable, whose current is to be measured. When mounted to the cable, the axis of the sensor coil 112 and the core of the coil are oriented perpendicular to the cable.

Conductors 120 are provided to extract the output voltage signal from the sensor coil 112. Connectors 122 and 124 are provided to allow the conductors 120 to be mated to other conductors in an extension cable (not shown).

The magnetic field generated around the cable whose current is to be measured induces an electromotive force (emf) in the sensor coil 112. As previously discussed, the induced emf is proportional to the instantaneous current intensity in the cable and creates a measurable voltage at the ends of the coil 112.

Figure 11:
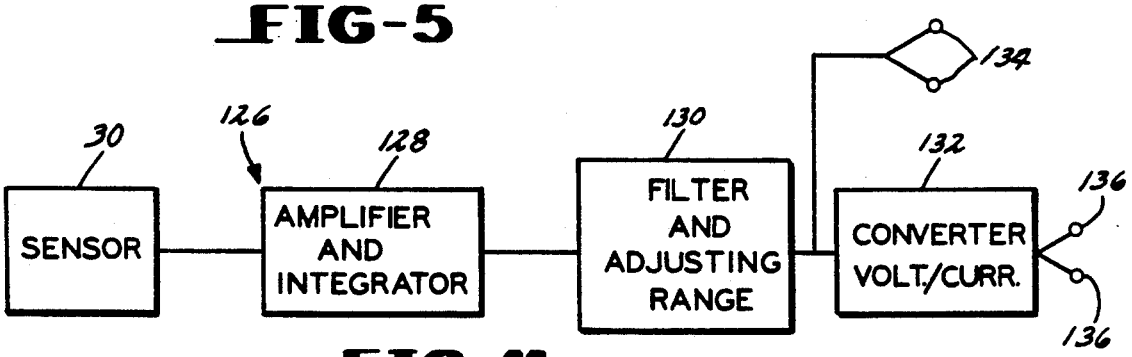
FIG. 11 illustrates the mechanism for normalizing the output of the current intensity loading sensor of the present invention.

As shown in FIG. 11, a signal conditioning circuit 126 can be provided to transform the induced emf into an instrumentation standard signal. The circuit 126 takes the voltage output signal from the sensor 30 and feeds it to an amplifier and integrator stage 128 in order to obtain a reasonable amplification combined signal in the range of 0 to 10 volts.

The amplified output from the stage 128 is passed to a filter and conditioning stage 130 which eliminates frequency noise higher than 5 Hz and at the same time, adjusts the output rank.

The output from the stage 130 can be used directly as an output signal or be conneqted to a voltage-to-current converter 132 in order to provide a current signal in the range of 4 to 20 mA. The voltage output occurs through terminals 134; while the current output occurs through terminals 136.

The stage 128 may comprise any suitable amplifying and integrating circuit(s) known in the art. The filter and conditioning stage 130 may comprise any desired filter and voltage adjusting circuit know in the art. Similarly, the voltage-to-current converter 132 may comprise any suitable voltage-to-current converter known in the art.

Figure 12:
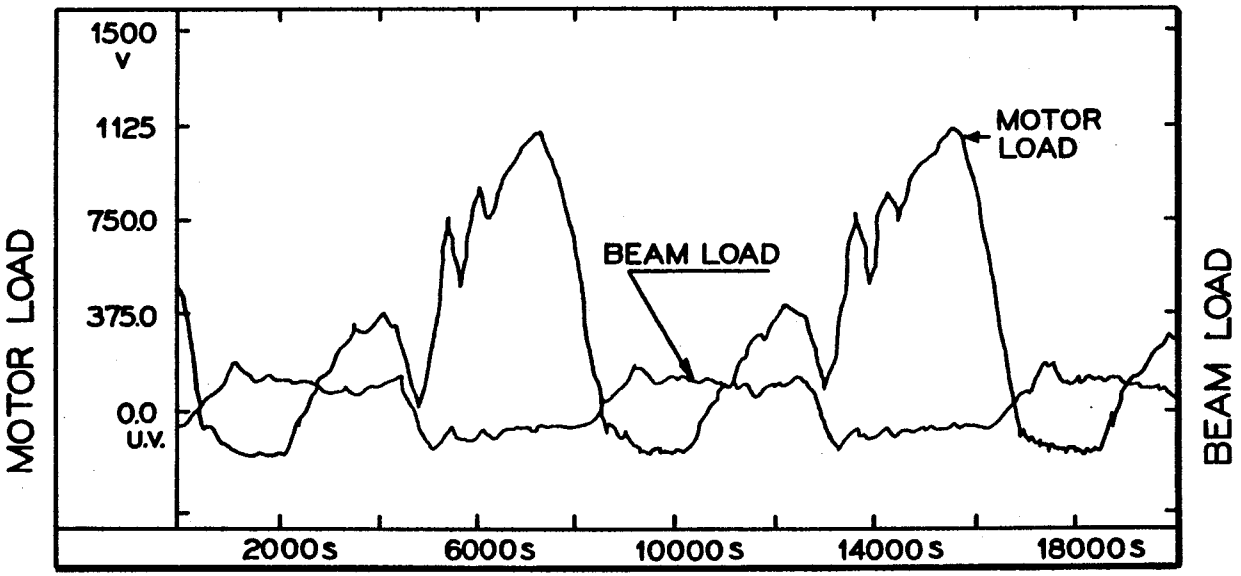
FIG. 12 illustrates a dynagraph having motor load superimposed over beam load as a function of time.

FIG. 12 illustrates a diagram on which beam load variation and motor load variation are plotted as a function of time. This diagram illustrates how beam load and motor load varies with each pumping cycle. The overlay of the curves permits detection of a wrong swinging movement due to bad positioning of a counterweight on the pumping unit.

The circuit 126 may be part of a printed circuit wire board assembly installed within a computer (not shown) or the like. The circuit 126 permits the integration of the sensor 30 into most standard instrumentation in current use.

While the sensors of the present invention have been described in connection with an oil well or oil pumping unit, it should be recognized that each of the sensors may be used separately or collectively in other environments.

It is apparent that there has been provided in accordance with this invention a system for monitoring oil well performance which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A system for monitoring performance of a pumping unit of an oil well which comprises:

a first sensor for measuring an inclination angle of a beam forming part of a pumping unit;

said first sensor including a pendulum member which moves in response to changes in the inclination angle of said beam and first means for generating an electrical signal indicative of said inclination angle;

a second sensor for measuring a load on said beam;

said second sensor including a deformable sensor plate mounted to said beam and second means for generating a signal indicative of the load on said beam attached to said sensor plate for measuring the deformation of said sensor plate;

a third sensor for measuring a load on an electrical motor used in conjunction with said pumping unit; and means for receiving information from the first, second and third sensors for monitoring the performance of said pumping.

2. The system of claim 1 further comprising:

said first sensor including a tubular housing at least partially filled with a viscous fluid; and said pendulum member being at least partially immersed in said viscous fluid.

3. The system of claim 2 further comprising:

said pendulum member including a cantilevered sheet and a counterweight attached to said cantilevered sheet.

4. The system of claim 3 wherein said first electrical signal generating means comprises a plurality of strain gauges affixed to surfaces of said sheet.

5. The system of claim 1 wherein said second means for generating a signal includes piezoresistive gauges affixed to said sensor plate.

6. The system of claim 5 wherein said second sensor further comprises two spaced apart extension plates forming a support for the sensor plate and each extension plate being welded to said sensor plate.

7. The system of claim 1 wherein said third sensor comprises a sensor head connected to a current carrying cable for supplying electrical power to said motor, said sensor head having a sensor coil and means for fixing the sensor head to the cable, whereby a magnetic field generated around said cable by said current flowing therethrough induces an electron current flow in the sensor coil.

8. The system of claim 7 further comprising means for conditioning an output signal of said third sensor to at least one of a standard current output and a standard voltage output.

9. The system of claim 8 wherein said conditioning means comprises a signal conditioning circuit having an amplifying and integrating stage for amplifying the output signal of the third sensor and a filtering and conditioning stage for eliminating frequency noise from the third sensor output signal and for adjusting the exit range of the third sensor output signal.

* * * * *